United States Patent [19]

Puskarich

[11] Patent Number: 4,799,656

[45] Date of Patent: Jan. 24, 1989

[54] ROLL-TRACTOR SPLITTER

[76] Inventor: Peter Puskarich, R.D. #5, Cadig, Ohio 43907

[21] Appl. No.: 71,397

[22] Filed: Jul. 9, 1987

[51] Int. Cl.[4] ..... B66F 5/04; B66F 7/28

[52] U.S. Cl. ..... 269/17; 254/2 B; 254/254; 254/134

[58] Field of Search ..... 254/2 R, 2 B, 7 R, 7 B, 254/8 R, 8 B, 133, 134; 269/17; 414/427

[56] References Cited

U.S. PATENT DOCUMENTS

| | | | |
|---|---|---|---|
| 1,014,992 | 1/1912 | Ames | 254/8 B |
| 2,807,380 | 9/1957 | Boehnke | 254/8 R |
| 3,040,908 | 6/1962 | Johnson . | |
| 3,095,182 | 6/1963 | Platt . | |
| 3,136,526 | 6/1964 | Wolf . | |
| 3,850,419 | 11/1974 | Craig . | |
| 3,931,956 | 1/1976 | Hawkins | 254/8 B |
| 3,937,443 | 2/1976 | Durgan . | |
| 3,948,484 | 4/1976 | Tesinsky . | |
| 3,949,976 | 4/1976 | Cofer | 2543/134 |
| 3,958,793 | 5/1976 | Garate . | |
| 4,123,038 | 10/1978 | Meyers | 254/134 |
| 4,383,681 | 5/1983 | Walters | 269/17 |
| 4,681,299 | 7/1987 | Siebert | 254/8 R |

FOREIGN PATENT DOCUMENTS

| | | | |
|---|---|---|---|
| 216700 | 2/1983 | German Democratic Rep. | 254/8 B |

*Primary Examiner*—Robert C. Watson

*Attorney, Agent, or Firm*—Wegner & Bretschneider

[57] ABSTRACT

A tractor splitter stand having a frame which articulates in order to provide for vertical adjustment of holes in an upright support with respect to tractor engagement holes is shown and described. Vertical adjustment is provided by a screw which controls the frame articulation, and by adjustment of side support members with respect to vertical extensions of the articulating frame.

27 Claims, 3 Drawing Sheets

ROLL-TRACTOR SPLITTER

BACKGROUND OF THE INVENTION

1. Field of the Invention

This invention relates to apparatus for supporting a frameless tractor when it is split at its midsection.

2. Description of the Prior Art

In the prior art known to applicant, there are a number of tractor splitting stands or supports for tractors when the tractor is split at the midsection. These prior art devices all include rigid frames which are moved about in the repair area on casters. The frames are not articulated, and adjustment to the height of tractor engagement holes is accomplished by adjustment of an engagement means which moves with respect to the frame which is carried by the casters. The caster carried frames do not articulate in order to provide for lifting and/or engagement of the tractor assembly.

U.S. Pat. No. 3,850,419 Craig shows a tractor splitter which includes caster 88, a hinge 52, and a coupler and stud 56 which are attached to the tractor drawbar. The height adjustment is provided only by jack 22, and there is no articulation of the frame portions 44 and 50 in order to provide for engagement of the tractor section. The drawbar 55 includes a vertical hole, and means for attachment such as a bolt. The Craig patent does not provide for articulating of the frame by lowering of the casters 88, in order to adjust the height of upright support means such as plate and screw 32, 28.

U.S. Pat. No. 3,949,976 shows a tractor stand pair where the frames of both the forward and rear half are mounted on casters. Again, the frame is not articulated at all, and provides only for lift devices such as telescopic members 1, 2, and 4. This patent shows only adjustment of height with respect to the frame, no articulation of the frame, and no movement of the axes of the casters with respect to each other as the tractor is engaged and/or lifted.

U.S. Pat. No. 3,136,526 Wolf shows a typical hydraulic jack wherein the lifting mechanism is raised with respect to the castered frame. Again, there is no articulation of the frame which moves the means (rolling wheels) with respect to each other, and which provides for raising of an engagement means by articulation of the frame upon which the wheels rest.

Other exmamples of rigid frames having casters and lift mechanisms which move with respect to the frame include U.S. Pat. Nos. 3,958,793 Garate, 3,095,182 Platt, 3,937,443 Durgan, and 3,040,908 Johnson.

The use of screw and nut device for raising and lowering or articulating mechanical device is, of course, well known as shown by U.S. Pat. Nos. 3,948,484 Tesinski and 3,040,908 Johnson.

BRIEF SUMMARY OF THE INVENTION

Applicant provides for an articulatable frame which when articulated adjusts the height of a means for engaging tractor engagement holes. The articulation provides for movement of a first set of wheels, or a long continuous roller with respect to a second set of wheels or second roller. As the frame is articulated, a portion of the frame moves downward with respect to the tractor, thereby forcing the other portion of the frame upward and into alignment with engagement holes on the tractor. The frame is articulated along a single axis or a pivot bar which extends transversely up the entire frame.

Rotation about the transverse pivot bar is provided by screw and nut mechanisms located on each side of the frame. As the screw and nut mechanisms are extended, the frame is forced to articulate by rotation of the wheels about the pivot bar axis.

This invention also includes a separate height adjusting means on the frame for course adjustment of the height of the upright support with respect to the tractor engagement holes. This provides a course adjustment and alignment of the tractor engagement holes with the holes in the upright support means. The fine adjustment is provided by turning the screw and nut mechanisms which articulate the frame, and which bring the holes of the support means and the tractor engagement holes into alignment.

This invention also includes a separate frame which may be connected to the forward half of the tractor. This frame also includes support screw mechanisms which may be lowered to the floor, and adjusted to provide for the correct height of the forward end of the tractor.

In applicant's device, there are three ways that the mechanism is adjusted to provide for alignment of the tractor transmission with the tractor bellhousing. The first alignment is accomplished by the rough adjustment of the upright support means. The second alignment is provided by articulation of the frame in response to the screw and nut mechanism. The third adjustment is provided by the support screws on the forward and supporting frames. With these three adjustment provisions, precise alignment of the bellhousing and transmission is assured, and accomplisheed with relative ease.

This invention also includes a horizontal slide bar which has moveable upright supports. This provides for adjustment of the upright supports horizontally with respect to the tractor engagement holes which may be of different widths.

The upright support means also include a plurality of holes in the upright support and the articulate frame through which boats pass and provide for vertical adjustment.

DETAILED DESCRIPTION OF THE PREFERRED EMBODIMENT

Figure 1:
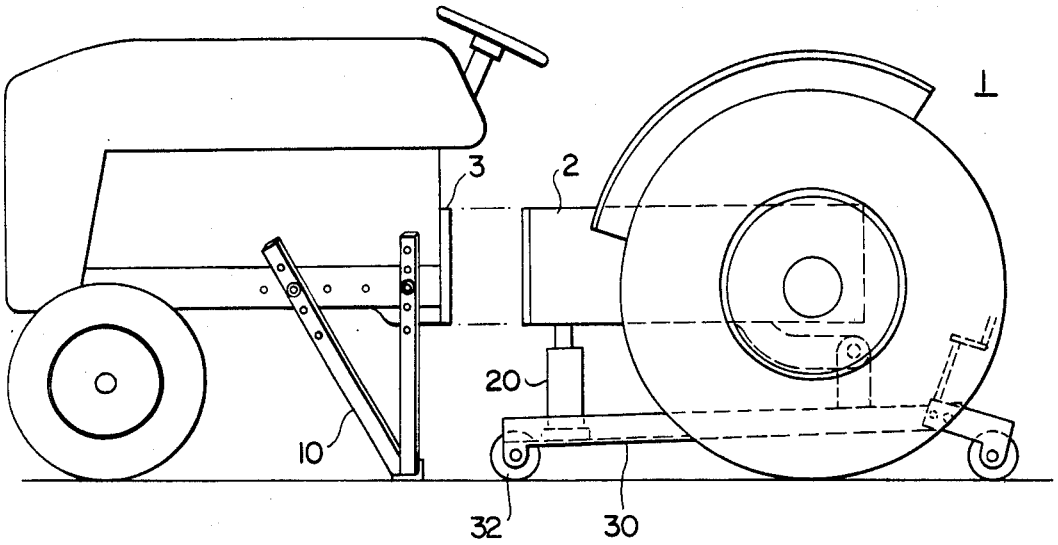
FIG. 1 shows a side view of a tractor which has just had the bellhousing removed from the transmission.
Figure 2:
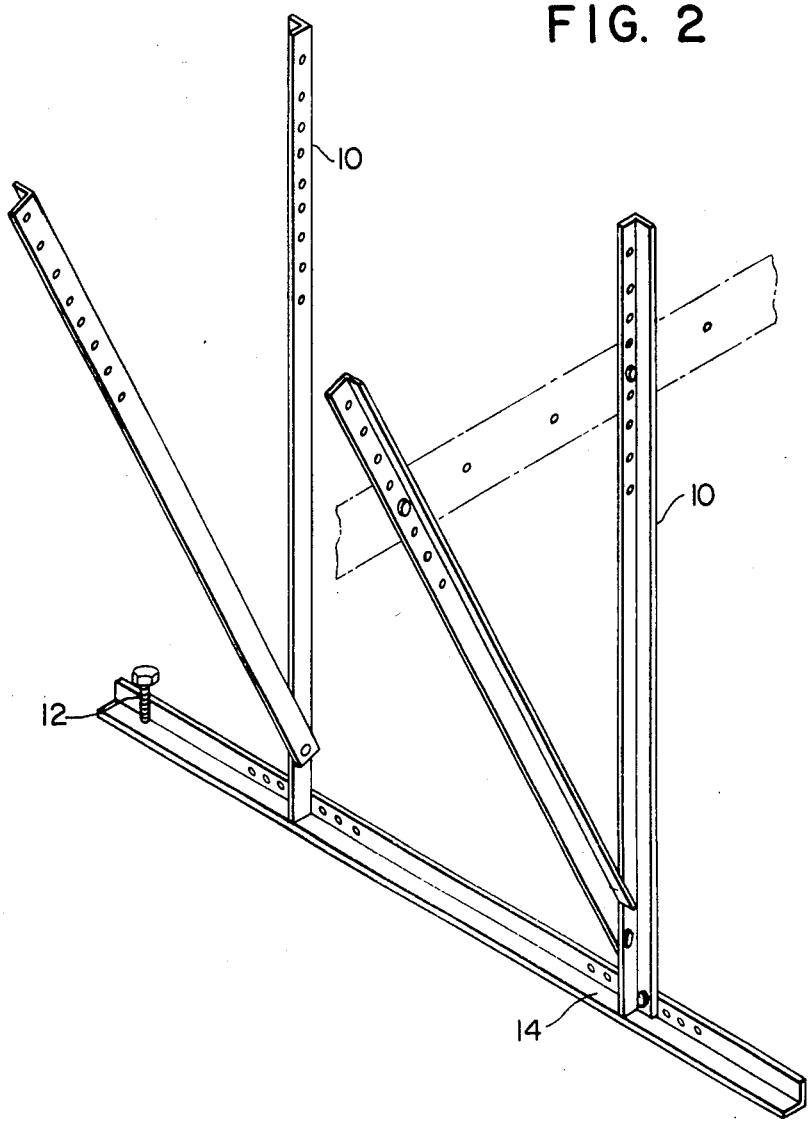
FIG. 2 shows the front support and leveling bracket.

In FIG. 1 there is shown a side view of a tractor 1 wherein the bellhousing 2 has just been removed from the transmission 3. The forward end of the split tractor is supported by a fixed frame 10 which is bolted to the chassis of the tractor 4. The fixed frame 10 also includes a means for adjusting its width such as the bolts and holes 14 which are placed through the steel brace at the bottom. The steel brace at the bottom also includes level adjusting screws 12 (FIG. 2) at each end thereof. The level adjusting screws provide for height adjustment of the bellhousing 3 with respect to the transmission 2 during disassembly and assembly.

The transmission 2 is supported by a jack 20 which is placed on the articulated frame 30. The jack 20 provides support to the transmission housing and is carried out by the frame 30 which rolls on a cylindrical roller 32 at the forward end of the articulatable frame.

Figure 4:
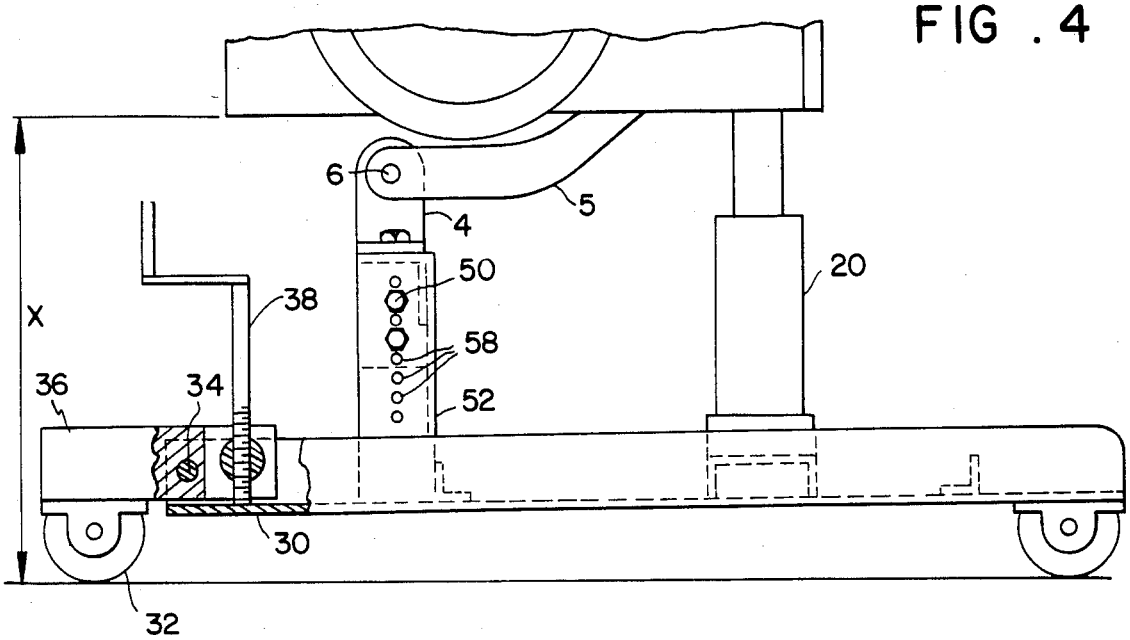
FIG. 4 shows a side view of the articulated frame with the frame in a straight condition.
Figure 5:
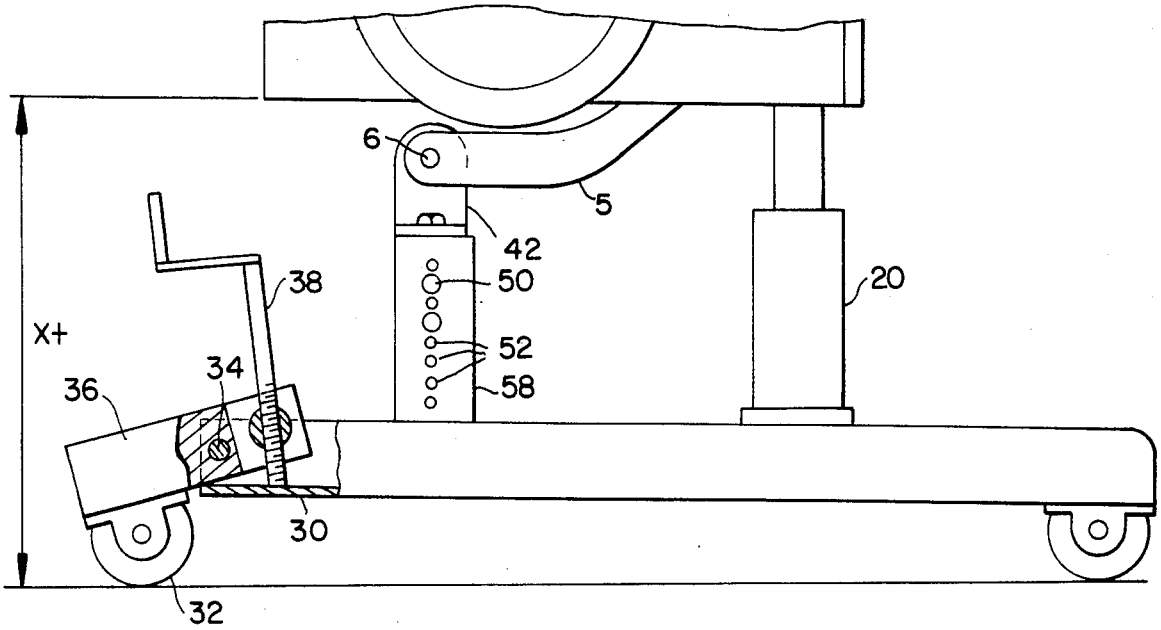
FIG. 5 shows a side view of the articulated frame wherein the frame has been articulated to lift the transmission and rear half of the tractor.

In FIGS. 4 and 5 there is shown the side view of the tractor of FIG. 1 as seen with the wheel removed in order to provide a veiw of the transmission housing and differential housing with the rear tractor splittert support in place. The transmission assembly includes a 3-point hitchbracket arm 5 which has a tractor engagement hole 6 located therein. In this particular embodiment, applicant has chosen to use the engagement hole 6 located in the 3-point hitchbracket arms, but any other suitable hole may be used for this attachment when available. As an alternative, the means for engaging the tractor could also connect to a rear drawbar such as the drawbar 55 shown in U.S. Pat. No. 3,850,419.

Figure 3:
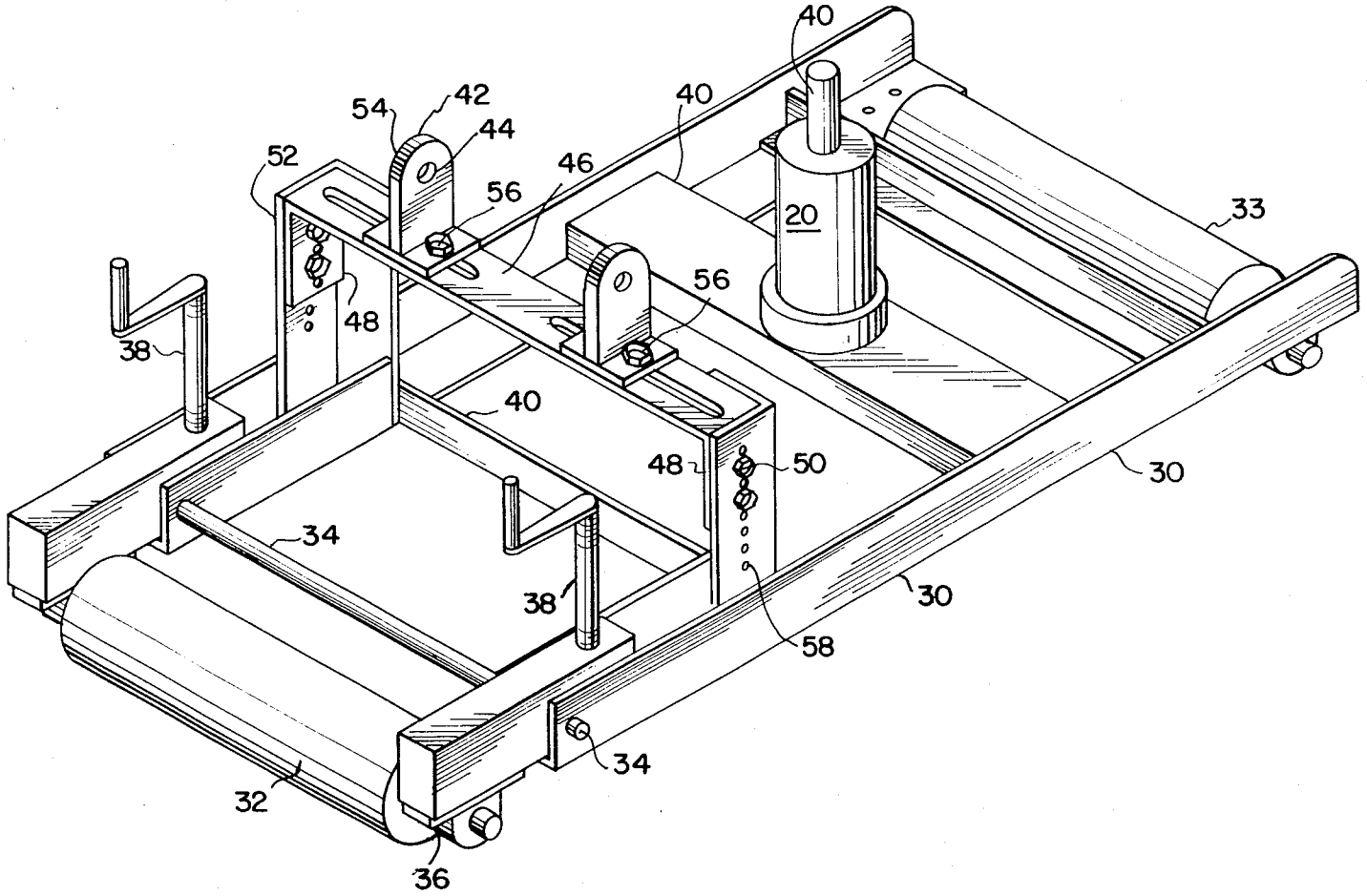
FIG. 3 shows a perspective view of the articulated roller portion of the tractor splitter.

Referring now to FIG. 3, there is shown a perspective view of the rear end articulatable frame 30. The frame articulates about a pivot bar 34 which runs from one side of the frame to the other. The short end 36 of the articulatable frame 30 rotates about pivot bar 34 when the screw 38 is run down onto the frame 30 thus forcing the short end 36 to rotate about pivot bar 34.

As short end 36 rotates, it necessarily forces the engagement hole 6 upward. At the same time, cylindrical roller 32 is moved downward, it also moves closer to roll 33. This action essentially tucks the roll 32 back underneath the frame 30 when it rotates. The frame 30 also includes one or more transverse beams or channels 40, one of which is used to hold the jack 20 when the forward end of the transmission 3 is supported by the jack 20.

Attached to the frame 30 is an upright support means 42 which includes a hole 44 for engaging the holes 6 in the 3-point hitchbreckets of the tractor 1. Vertical adjustment of the height of hole 44 is first provided by adjusting the height of the horizontal bar 46 by raising the side support members 48 until the approximate height of the holes in the 3-point hitchbracket are reached. Bolts 50 are then inserted between the side support member 48 and a vertical extension 52 of the frame 30. The height of the hole 44 should be adjusted so that it is slightly lower than the holes in the 3-point hitchbracket so that final height adjustment may be achieved by turning screws 38, rotating the roller 32 downward, and thereby raising the height of hole 44 to the final position and alignment with the hole 6 in the 3-point hitchbracket 5. When alignment is achieved, a bolt or a pin may be placed through the hole 44 and the hole in the 3-point hitchbracket, thereby securing the tractor to the rear half of the splitter.

Since different tractors may have different location of suitable engagement holes 6 located at different places, it is also necessary to provide for horizontal adjustment of the location of the holes 44 of the upright support means 42. This is provided as can be seen in FIG. 4 where the upright support also includes a T-shaped bracket 54 which slides along the horizontal bar 46. The location of the T-shaped bracket 54 can then be fixed by tightening the bolts 56 which secure the T-shaped bracket 54 to the horizontal bar 46.

The upright support means 42 is located at the end of the frame 30 which is closest to the articulating short end 36. This provides for the maximum height adjustment of the holes 44 as the short end 36 is rotated.

The tractor splitter in accordance with this invention is used in the following manner. The forward fixed frame 10 is fixed to the front of the tractor 1 and the level adjusting screws 12 are run down to take the weight of the forward end of the tractor. Next the rearward articulatable frame means 30 is rolled beneath the tractor at the rear until the holes 44 in the T-shaped brackets 54 are approximately beneath the 3-point hitchbracket 5 of the tractor. Next the tractor engagement holes 6 which are located in the 3-point hitchbracket 5 are brought into alignment with the holes 44 of the T-shaped brackets 54. First, the separation between the T-shaped brackets 54 is set by adjusting the position of the T-shaped brackets 54 on the horizontal slide bar 46. Then bolts 56 are tightened to secure the T-shaped brackets 54 on the bar. Next the height of holes 44 is adjusted to the height of the tractor engagement holes 6. First, the upright support means 42 is adjusted in height by raising the side support member 48 with respect to the vertical extension 52 of the frame. When holes 58 are aligned, and when hole 44 is slightly below the tractor engagement hole 6, bolts 50 are set to secure the side support member 48 to the vertical extension 52. Once the rough adjustment has been accomplished, a fine adjustment of the height of holes 44 is then provided by articulation of the frame 30. The short end of the frame 36 is articulated downward where roller 32 tucks back underneath the frame, and moves downward as well as horizontally in the direction of roller 33, thus raising the height of hole 44. A bolt or suitable pin is then placed through the holes 44 and the tractor engagement holes 6 to secure the tractor transmission or differential housing to the articulatable frame by attachment to the upright support means 42. Next a jack 20 is placed on the horizontal member or beam of channel 40 of the frame 30. Then, the jack 20 is extended upwardly in order to engage the forward portion of the transmission of the tractor to be split. When the jack 20 begins to carry the weight of the transmission housing, the bolts securing the transmission housing 2 to the bellhousing 3 may be removed. Upon removal of the bellhousing bolts, the entire rear half of the tractor may be rolled away from the forward half of the tractor by pushing the entire assembly rearward away from the bellhousing. The vertical adjustment provided by the articulation of the frame in response to screw adjustment 38 may also be used to further raise the rear end of the tractor in order to provide for easy rolling (with the tractor wheels off the ground) or to provide for sufficient height adjustment to raise the rear end so that the tractor wheels may be removed.

Reassembly of the tractor is essentially a reversal of the steps taken to remove the rear end. In reassembly, the adjustment of the location of the holes in the bellhousing 3 and the holes in the transmission 2 may be finally adjusted by either changing the height of the bellhousing by adjusting level adjusting screws 12 in the fixed frame 10, or by articulating the frame 30 by means of adjustment screws 38 to achieve the height of both the fixed frame and the articulated frame.

The present invention has been shown and described with reference to a particular embodiment. It should, however, be understood that various changes and modifications which are obvious to a person skilled in the art to which this invention pertains are deemed to lie within the spirit, the scope, and contemplation of the invention.

I claim:

1. A tractor splitting stand for separating the front and rear halves of a frameless tractor when the transmission bellhousing is unbolted from the forward half of the tractor, said tractor having at least one tractor engagement hole located in the rear half, comprising:

an articulatable frame having first and second ends;

rolling means connected to said frame for moving said frame;

upright support means on said frame for engaging said tractor engagement holes by pinning said upright support means to said tractor engagement holes, said upright support means comprising a horizontal slide bar and movable upright supports which may be moved horizontally on said horizontal slide bar; and means for articulating said frame whereby said first end is pivoted with respect to the second end, thereby raising the frame vertically and raising said upright support means.

2. A tractor splitting stand for separating the front and rear halves of a frameless tractor when the transmission bellhousing is unbolted from the forward half of the tractor, said tractor having at least one tractor engagement hole located in the rear half, comprising:

an articulatable frame having first and second ends;

rolling means connected to said frame for moving said frame;

upright support means on said frame for engaging said tractor engaging holes by pinning said upright support means to said tractor engagement holes; and means for articulating said frame whereby said first end is pivoted with respect to the second end, thereby raising the frame vertically and raising said upright support means;

wherein both said upright support means and said articulating means are located at said first end of the frame.

3. A tractor splitting stand for separating the front and rear halves of a frameless tractor when the transmission bellhousing is unbolted from the forward half of the tractor, said tractor having at least one tractor engagement hole located in the rear half, comprising:

an articulatable frame having first and second ends;

two extended rolling cylinders, one located at each end of said frame, for moving said frame;

upright support means on said frame for engaging said tractor engagement holes by pinning said upright support means to said tractor engagement holes; and means for articulating said frame whereby one of said rolling cylinders is lowered vertically with respect to said frame, thereby raising the frame vertically and raising said upright support means.

4. A tractor splitting stand for separating the front and rear halves of a frameless tractor when the transmission bellhousing is unbolted from the forward half of the tractor, said tractor having at least one tractor engagement hole located in the rear half, comprising:

an articulatable frame having first and second ends;

rolling means connected to said frame for moving said frame;

upright support means on said frame for engaging the rear half of the tractor, said upright support means having holes which are aligned with the tractor engagement holes by adjustment of the height of said upright support means, said upright support means being pinned to said tractor engagement holes; and means for articulating said frame whereby said first end is pivoted with respect to the second end, thereby raising the frame vertically and raising said upright support means.

5. A tractor splitting stand for separating the front and rear halves of a frameless tractor when the transmission bellhousing is unbolted from the forward half of the tractor, said tractor having at least one tractor engagement hole located in the rear half, comprising:

an articulate frame having first and second ends;

rolling means connected to said frame for moving said frame;

upright support means on said frame for engaging said tractor engagement holes by pinning said upright support means to said tractor engagement holes;

means for articulating said frame whereby said first end is pivoted with respect to the second end, thereby raising the frame vertically and raising said upright support means; and means for raising and lowering said upright support means with respect to said frame, comprising a plurality of bolt holes in said upright support means, a plurality of bolt holes in said frame, and at least one bolt which can engage said bolt holes;

wherein said upright support means is first roughly adjusted to the height of the tractor engagement holes by adjusting the alignment of the bolt holes of said raising and lowering means, and then finally aligned with the tractor engagement holes by articulating said frame.

6. A tractor splitting stand for separating the front and rear halves of a frameless tractor when the transmission bellhousing is unbolted from the forward half of the tractor, said tractor having at least one tractor engagement hole located in the rear half, comprising:

an articulatable frame having first and second ends;

rolling means connected to said frame for moving said frame;

upright suport means on said frame for engaging said tractor engagement holes by pinning said upright support means to said tractor engagement holes;

means for articulating said frame whereby said first end is pivoted with respect to said second end, thereby raising the frame vertically and raising said upright support means; and a fixed frame which is bolted to the front half of the tractor for holding the front half when the rear half is removed.

7. A tractor splitter stand in accordance with claim 1, wherein said rolling means comprises a first roller connected to the first end of the frame and a second roller connected to the second end of the frame, wherein said second roller is lowered vertically when said articulating means raises the frame vertically.

8. A tractor splitter stand in accordance with claim 7, wherein said articulating means includes a pivot bar which extends transversely across said frame and about which said second roller pivots when said second roller is raised or lowered.

9. A tractor splitter stand in accordance with claim 1, wherein said articulating means comprises at least one threaded screw-and-nut means for actuating said articulating means.

10. A tractor splitter stand in accordance with claim 2, wherein said rolling means comprises a first roller connected to the first end of the frame and a second roller connected to the second end of the frame, wherein said second roller is lowered vertically when said articulating means raising the frame vertically.

11. A tractor splitter stand in accordance with claim 10, wherein said articulating means includes a pivot bar which extends transversely across said frame and about which said second roller pivots when said second roller is raised or lowered.

12. A tractor splitter stand in accordance with claim 2, wherein said articulating means comprises at least one threaded screw-and-nut means for actuating said articulating means.

13. A tractor splitter stand in accordance with claim 3, wherein said articulating means includes a pivot bar which extends transversely across said frame and about which said one of said rolling cylinders pivots when said one of said rolling cylinders is raised or lowered.

14. A tractor splitter stand in accordance with claim 3, wherein said articulating means comprises at least one threaded screw-and-nut means for actuating said articulating means.

15. A tractor splitter stand in accordance with claim 4, wherein said rolling means comprises a first roller connected to the first end of the frame and a second roller connected to the second end of the frame, wherein said second roller is lowered vertically when said articulating means raises the frame vertically.

16. A tractor splitter stand in accordance with claim 15, wherein said articulating means includes a pivot bar which extends transversely across said frame and about which said second roller pivots when said second roller is raised or lowered.

17. A tractor splitter stand in accordance with claim 4, wherein said articulating means comprises at least one threaded screw-and-nut means for actuating said articulating means.

18. A tractor splitter stand in accordance with claim 5, wherein said rolling means comprises a first roller connected to the first end of the frame and a second roller connected to the second end of the frame, wherein said second roller is lowered vertically when said articulating means raises the frame vertically.

19. A tractor splitter stand in accordance with claim 18, wherein said articulating means includes a pivot bar which extends transversely across said frame and about which said second roller pivots when said second roller is raised or lowered.

20. A tractor splitter stand in accordance with claim 5, wherein said articulating means comprises at least one threaded screw-and-nut means for actuating said articulating means.

21. A tractor splitter stand in accordance with claim 6, wherein said rolling means comprises a first roller connected to the second end of the frame, wherein said second roller is lowered vertically when said articulating means raises the frame vertically.

22. A tractor splitter in accordance with claim 21, wherein said articulating means includes a pivot bat which extends transversely across said frame and about which said second roller pivots when said second roller is raised or lowered.

23. A tractor splitter stand in accordance with claim 6, wherein said articulating means comprises at least one threaded screw-and-nut means for actuating said articulating means.

24. A tractor splitter stand in accordance with claim 2 wherein said frame includes a horizontal member located proximate to said second end and a jack means located on said horizontal member for supporting said tractor rear half.

25. A tractor splitter stand in accordance with claim 4 further comprising a bolt which extends through said tractor engagement holes and said upright support means holes.

26. A tractor splitter stand in accordance with claim 6 wherein said fixed frame includes screw adjustments for adjusting the height of said front half.

27. A tractor splitter stand as set forth in claim 26 wherein alignment of said transmission bellhousing is provided by articulating said frame, by setting the height of said upright support means, and by adjusting said front half fixed frame screw adjustments.

* * * * *